US010914429B1

(12) United States Patent
Liu

(10) Patent No.: US 10,914,429 B1
(45) Date of Patent: Feb. 9, 2021

(54) LED LIGHTING APPARATUS HAVING SWITCH ACTUATED BY ROTATING COLLAR

(71) Applicant: XIAMEN ECO LIGHTING CO. LTD., Xiamen (CN)

(72) Inventor: Jinyong Liu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/719,789

(22) Filed: Dec. 18, 2019

(30) Foreign Application Priority Data

Jul. 16, 2019 (CN) ..... 2019 2 1115226 U

(51) Int. Cl.

| | |
|---|---|
| ***F21V 23/04*** | (2006.01) |
| ***F21K 9/237*** | (2016.01) |
| ***F21K 9/233*** | (2016.01) |
| *F21Y 115/10* | (2016.01) |

(52) U.S. Cl.
CPC ..... *F21K 9/237* (2016.08); *F21K 9/233* (2016.08); *F21V 23/0435* (2013.01); *F21Y 2115/10* (2016.08)

(58) Field of Classification Search
CPC ..... F21V 23/006; F21V 23/104; F21K 9/233; F21K 9/237; F21K 9/238; H01H 19/60; H01H 19/62; H01H 19/635; H01H 2221/018
See application file for complete search history.

(56) References Cited

U.S. PATENT DOCUMENTS

| | | | | |
|---|---|---|---|---|
| 2,862,085 | A * | 11/1958 | Brandeis | F21V 23/04 200/294 |
| 3,147,928 | A * | 9/1964 | Carpenter | F21V 23/04 362/394 |
| 4,685,759 | A * | 8/1987 | Kurtz | H01R 33/9555 200/336 |
| 8,853,950 | B1 * | 10/2014 | Chang | H05B 47/105 315/127 |
| 9,125,271 | B2 * | 9/2015 | Martins | F21K 9/237 |
| 9,657,928 | B1 * | 5/2017 | Jacobson | F21V 23/04 |
| 9,918,371 | B2 * | 3/2018 | Jacobson | H05B 45/00 |
| 10,104,742 | B2 * | 10/2018 | Halliwell | F21K 9/238 |
| 10,415,765 | B1 * | 9/2019 | Grandadam | F21K 9/235 |
| 2004/0264187 | A1 * | 12/2004 | Vanderschuit | H05B 47/10 362/235 |
| 2005/0135107 | A1 * | 6/2005 | Currie | H01R 33/94 362/382 |
| 2011/0095687 | A1 * | 4/2011 | Jonsson | F21K 9/232 315/51 |
| 2016/0161102 | A1 * | 6/2016 | Chou | F21S 6/008 362/249.02 |

FOREIGN PATENT DOCUMENTS

| | | | | |
|---|---|---|---|---|
| WO | WO-2019072114 | A1 * | 4/2019 | F21K 9/232 |

* cited by examiner

*Primary Examiner* — Ismael Negron
(74) *Attorney, Agent, or Firm* — Chun-Ming Shih; Lanway IPR Services

(57) ABSTRACT

A lighting apparatus includes a connector, a housing connected to the connector, a light source assembly provided in the housing and having a driving board electrically connected to a light source board, and a ring-shaped element rotatably secured to an outer surface of the housing and configured such that rotation of the ring-shaped element operates the switch.

17 Claims, 6 Drawing Sheets

LED LIGHTING APPARATUS HAVING SWITCH ACTUATED BY ROTATING COLLAR

FIELD OF INVENTION

The present invention is related to a lighting apparatus, and more particularly related to a lighting apparatus with multiple variable settings.

BACKGROUND

Since Edison invented improved light bulbs, various lighting apparatus are developed and widely used in everywhere of human life. In past ten years, LED (Light Emitted Diode) technology has significant advancement. LED technology is therefore gradually adopted in lighting devices.

Among LED lighting devices, light bulbs are an important type of lighting devices. The incandescent light bulbs are used for one hundred years and now are more and more replaced with LED light bulbs.

LED light bulbs have many advantages. However, it is always beneficial for human life if more flexibility may be added to LED light bulbs and other light devices, particularly when the amount of LED devices is so large.

SUMMARY OF INVENTION

According to an embodiment, a lighting apparatus includes a connector, a housing, a light source assembly, and a ring-shaped element.

The housing is connected to the connector. The housing may be made of thermal and/or heat dissipation material like plastic or other material like metal.

The light source assembly is configured within the housing. In other words, the light source assembly is placed in the housing. The light source assembly includes a driving board and a light source board. The light source assembly may be LED components. The lighting apparatus may be a bubble light, a halogen lamp, a mercury lamp, a tungsten filament lamp or other lighting devices.

The driving board electrically connects to the light source board, and a switch is configured on the driving board. Example of the switch is a pushing switch. For example, the switch and other driver circuit components are mounted on a circuit board to form the driving board. The switch may be a mechanic switch or an electronic switch. The switch may have multiple positions corresponding to different options for driving the light source board. For example, there are multiple LED modules on the light source board and the different options correspond to different parameters for driving the LED modules, e.g. to turn on some LED modules and turn off some LED modules or to adjust relative strengths of LED modules of different color temperatures for mixing multiple corresponding color temperatures.

The ring-shaped element is movably fixed on an outer surface of the housing. The ring-shaped element interferes with the switch. An example of the ring-shape element is a rotating ring with an example mentioned below. The ring-shaped element may have a circular shape, an C shape, a ellipse shape, a cylinder shape, or a polygonal shape.

In some embodiments, a first end of the housing has a rim forming an opening, and a second end of the housing is fixed within the connector.

In some embodiments, a first protrusion ring and a latch are formed on an inner side of the ring-shaped element. The first protrusion ring and the latch are configured in sequence along an axial direction of the opening away from the connector. The second end of the housing has a second protrusion ring movably fixed between the first protrusion and the latch, and a first ring-shaped slot is formed between the first and the second protrusion.

In some embodiments, two fixing blocks are formed on the inner side of the ring-shaped element. The fixing blocks protrudes toward the driving board, and the switch is located between the two fixing blocks.

In some embodiments, the switch protrudes toward the ring-shaped element and extends outside of the housing.

In some embodiments, the two fixing blocks extend into the housing.

In some embodiments, the ring-shaped element is slidable along the axial direction of the opening. The fixing blocks are configured to push the switch to different positions to selectively control the driving board to output different control signals in response to a distance between the ring-shaped element and the connector.

In some embodiments, when the distance is less than a predetermined distance, the light source board is configured to emit light having a color temperature between 5000 k and 6000 k in response to the control signals output by the driving board. In addition to color temperatures, light colors, luminous level and/or other parameters may be configured with such mechanism.

In some embodiments, the lighting apparatus may include a communication interface. When the distance is less than a predetermined distance, the driving board is configured to output the control signals to activate the communication interface.

In some embodiments, the communication interface is configured to be WIFI or Bluetooth. Other wireless protocols may be used for different requirements.

In some embodiments, the ring-shaped element rotates relative to the connector along the axial direction of the opening. The fixing blocks are configured to push the switch to different positions to selectively control the driving board to output different control signals in response to a relative rotation of the ring-shaped element and the connector.

In some embodiments, the light source board includes a substrate and a plurality of light emitting diode (LED) emitters configured on the substrate.

In some embodiments, when the ring-shaped element rotates to a first position, a portion of the LED emitters are turned off.

In some embodiments, when the ring-shaped element rotates to a first position, the driving board controls the adjacent LED emitters to turn on and turn off alternatively.

In some embodiments, reflective material is coated on the substrate.

In some embodiments, the second end of the housing has a first step structure. One end of the ring-shaped element away from the connector extends into the first step structure.

In some embodiments, the limiting groove is formed on the first step structure. An upper end of the ring-shaped element extends to the limiting groove, such that the relative rotation between the ring-shaped element and the connector is limited.

In some embodiments, a second step structure is formed on an outer surface of the ring-shaped element, the housing comprises a surrounding cover adjacent to the second end, the surrounding cover extends toward the connector and abuts against the second step structure.

In some embodiments, a first sealing ring is sleeved on the first ring-shaped slot, and the housing and the ring-shaped element cooperatively holding the first sealing ring.

In some embodiments, a second ring-shaped slot is formed on an outer surface of the housing corresponding to the ring-shaped element, a second sealing ring is sleeved on the second ring-shaped slot, and the surrounding cover and the housing cooperatively holding the second sealing ring.

DETAILED DESCRIPTION

Figure 1:
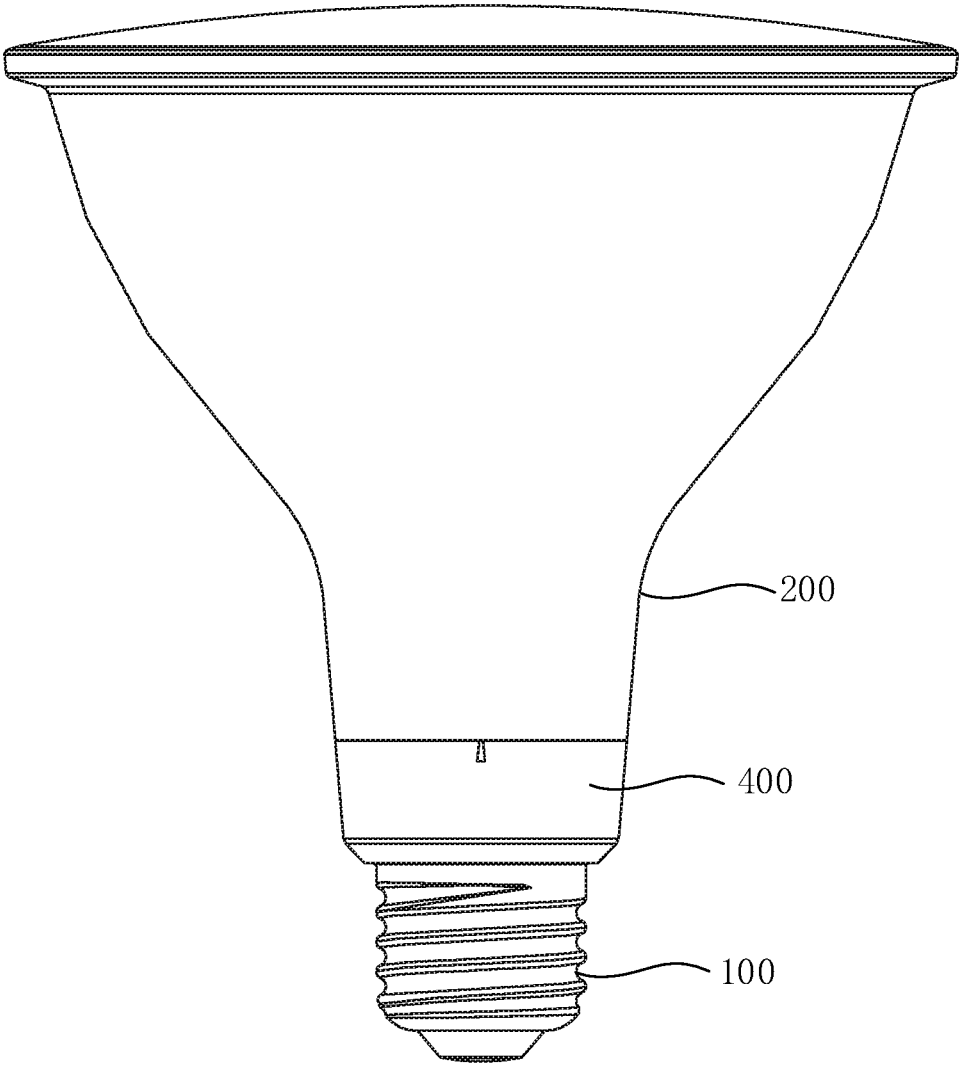
FIG. 1 is a diagram illustrating a lighting apparatus embodiment.
Figure 2:
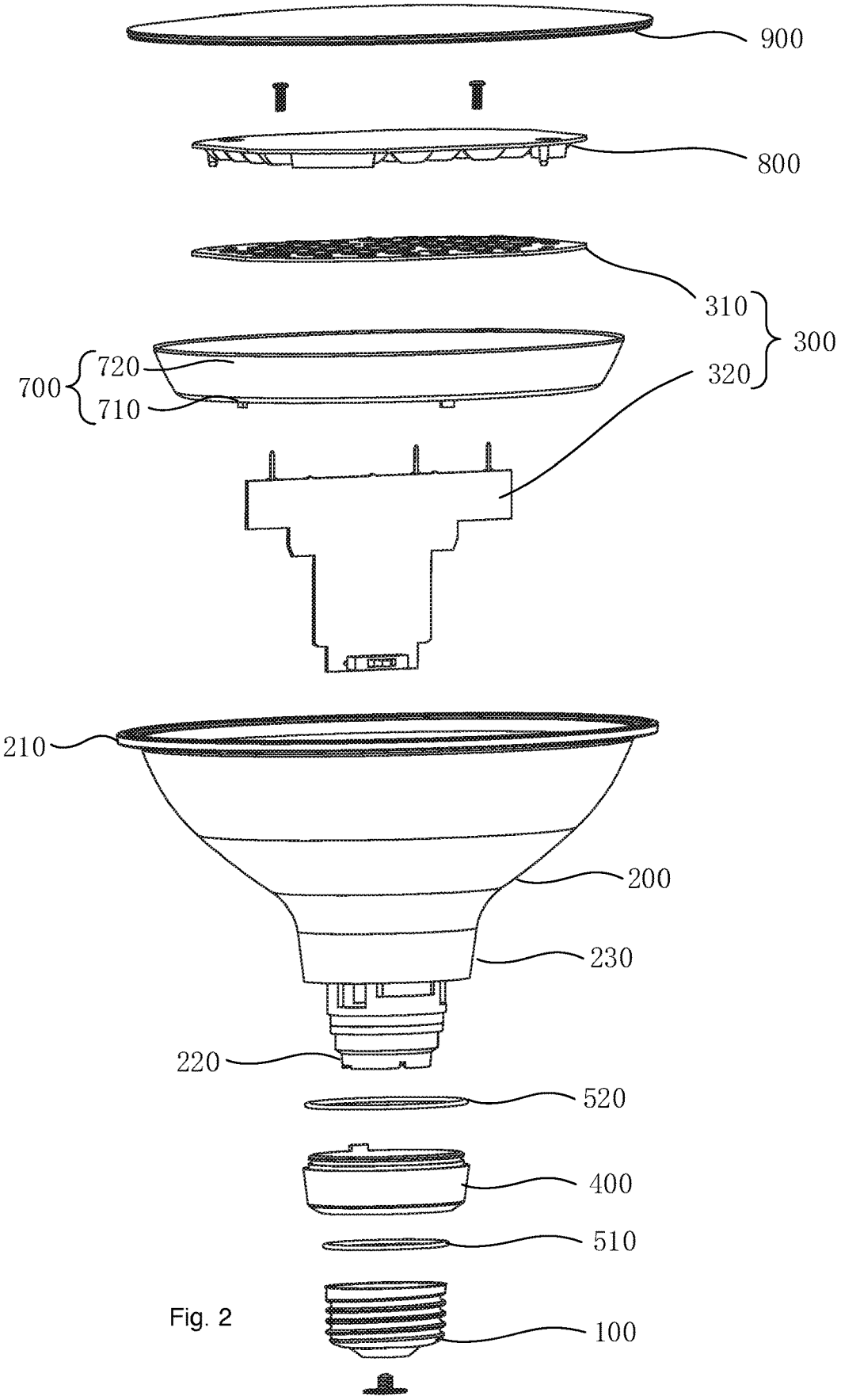
FIG. 2 is an exploded diagram of a lighting apparatus embodiment of FIG. 1.

In FIG. 1 and FIG. 2, a lighting apparatus, like a light bulb, includes a cap 100, a light housing 200, a light source assembly 300 and a rotation switch assembly 400.

The light housing 200 is fixed to the cap 100. The light source assembly 300 is placed in the light housing 200.

The rotation switch assembly 400 includes a rotating ring 410 and a pushing switch 420. The rotating ring 410 has a rotatable connection to the light housing 200.

The rotation switch 420 is disposed in the light housing 200 and electrically connected to a light source assembly 300. A first end of the pushing switch 420 is extended outside the light housing 200 and form a rotation pushing structure with the rotating ring 410.

After the light housing 200 and the cap 100 are connected and fixed, the external screw of the cap 100 is used for installing the lighting apparatus to a working environment, so that an external power source is supplied to the light source assembly to emit light. In addition, the rotation switch assembly 400 is used for changing an output color temperature of the lighting apparatus.

During the rotation of the rotating ring 410, the rotating ring 410 brings and moves the pushing switch 420 so that the pushing switch 420 corresponds to a light emitting status of the light source assembly 300.

In some other embodiments, the rotation may be used for turning off the lighting apparatus, for changing a color of the lighting apparatus, enabling or disabling some function like wireless communication, e.g. among Bluetooth, Wi-Fi and other protocols, or performing other parameter settings of the lighting apparatus.

Different rotation directions may be used for corresponding to different parameters. In addition to rotation, the pushing switch may be moved in a linear direction, e.g. up-down, instead of rotation. In such method, there is an external housing moving relative to an inner housing to move corresponding switch for generating different settings to the driving circuits.

Besides, in addition to discrete options, a continuous range may be used for setting the parameters of the light source assembly. Specifically, the rotation distance may correspond to a parameter level, instead of selecting one from multiple options.

For example, the rotation movement may correspond to select one from four modes. In other design, the rotation movement may correspond to select a value between 0 to 1, where the value corresponds to an adjustment level for the light source assembly mentioned above, e.g. mixing a different color or a different color temperature.

With such design, the user does not need to worry which side of the switch is facing to. Instead, by rotating the rotating ring as mentioned above, a necessary mode may be indicated for the driver to change behavior of the light source assembly, e.g. to change a color temperature.

In one embodiment, the light housing 200 has a tube shape. two sides of the light housing 200 is a wide open end 210 and a narrow open end 220. The light source assembly 300 is disposed inside the wide open end 210 and emits light outside the wide open end 210.

The narrow open end 220 is extended into the cap 100 to fix to the cap 100.

Figure 3:
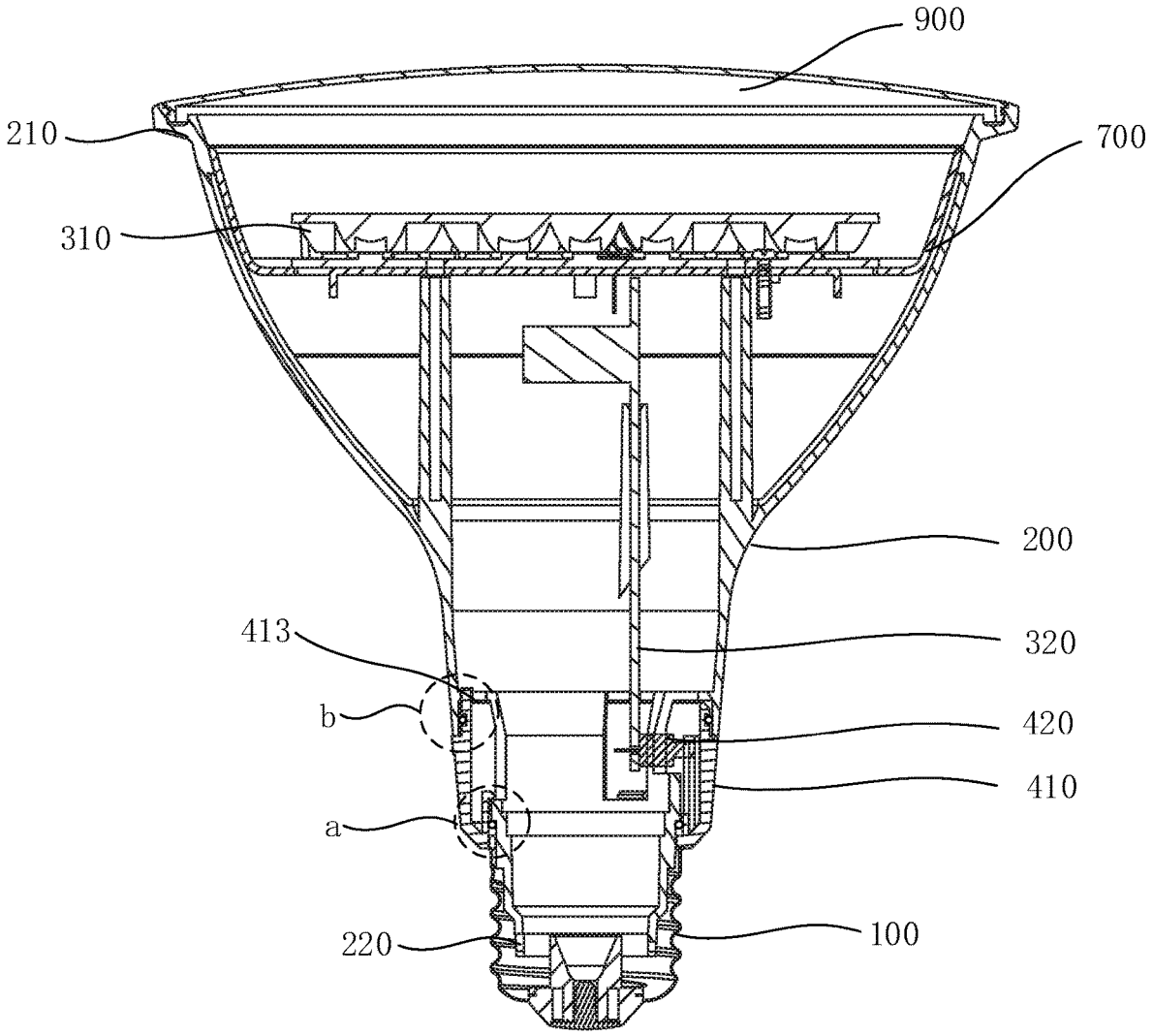
FIG. 3 is a cross-sectional view of the embodiment of FIG. 1.
Figure 4:
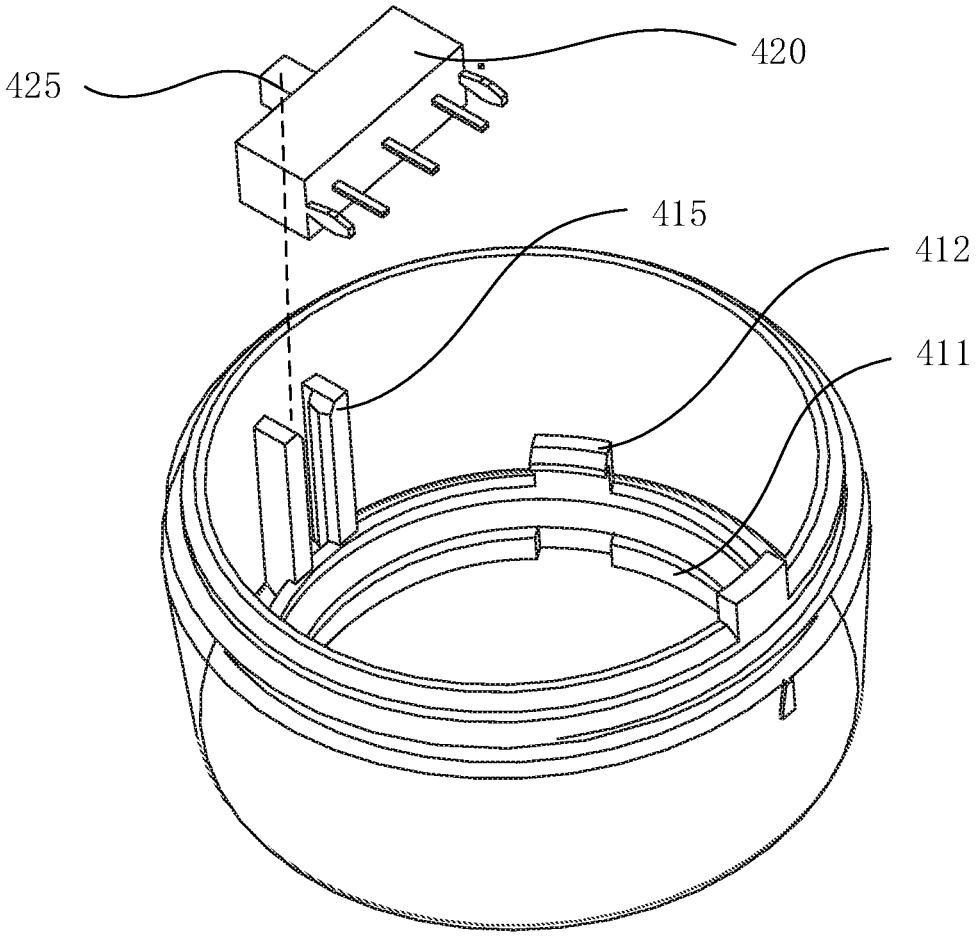
FIG. 4 illustrates a rotating switch assembly.
Figure 6:
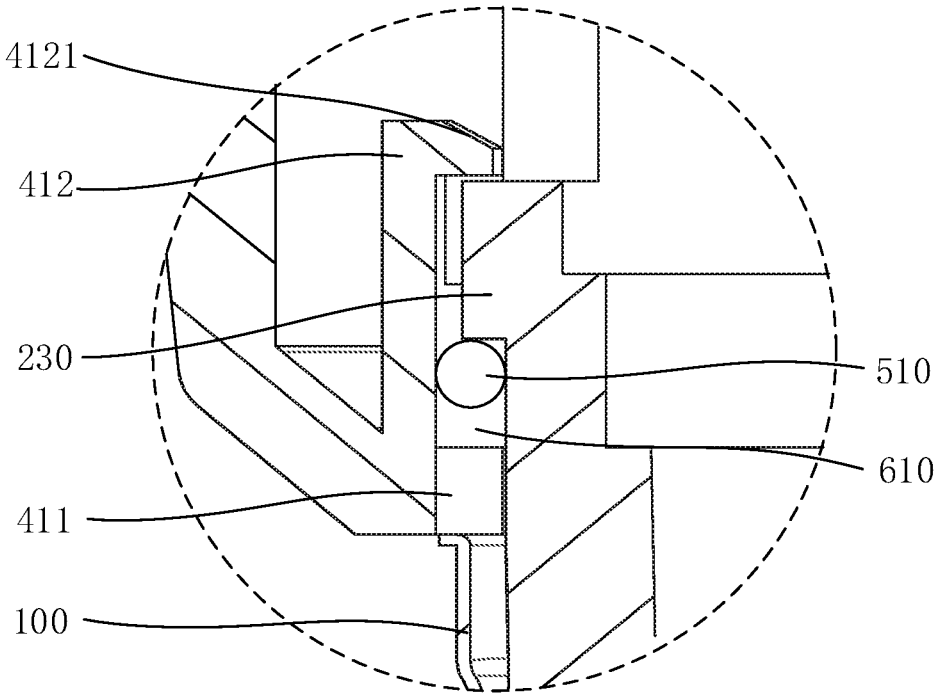
FIG. 6 is a zoom-up view of the position a in FIG. 3.

Please also refer to FIG. 3, FIG. 4 and FIG. 6. There is a first protruding edge 411 disposed on a top ring of an inner wall of a bottom of the rotating ring 410. There is a buckle 412 disposed on an upper side of the first protruding edge 411, on a side away from the bottom inside the rotating ring 410. There is a second protruding edge 230 disposed on an external wall of the narrow open end 220. The second protruding edge 230 is between the first protruding edge 411 and the buckle 412 so that the rotating ring 410 may have a rotatable connection to the light housing 200 to prevent the rotating ring 410 to escape from the light shell 200.

Please be noted that the bottom of the rotating ring 410 may refer to the side that is closer to the cap 100 when the lighting apparatus is assembled.

Furthermore, the first protruding edge 411 may be a ring structure or have multiple segments with gaps therebetween. In this embodiment, the number of the buckles 412 is three. Three buckles 412 are arranged in the same circle with 120 degrees to adjacent buckles.

The distance and number of the buckles 412 may be adjusted according to different design needs, e.g. to consider the side of the light shell 200 or the dimension of the rotating ring 410.

For example, there may be two buckles on two sides of the rotating ring 410. There is a wedge surface on a top of the buckle 412 tilt toward the bottom of the rotating ring 410. During the assembly of the light housing 200 and the rotating ring 410, the wedge surface 4121 is used for guiding the second protruding edge 230 to enter the position between the first protruding edge 411 and the buckle 412.

Figure 5:
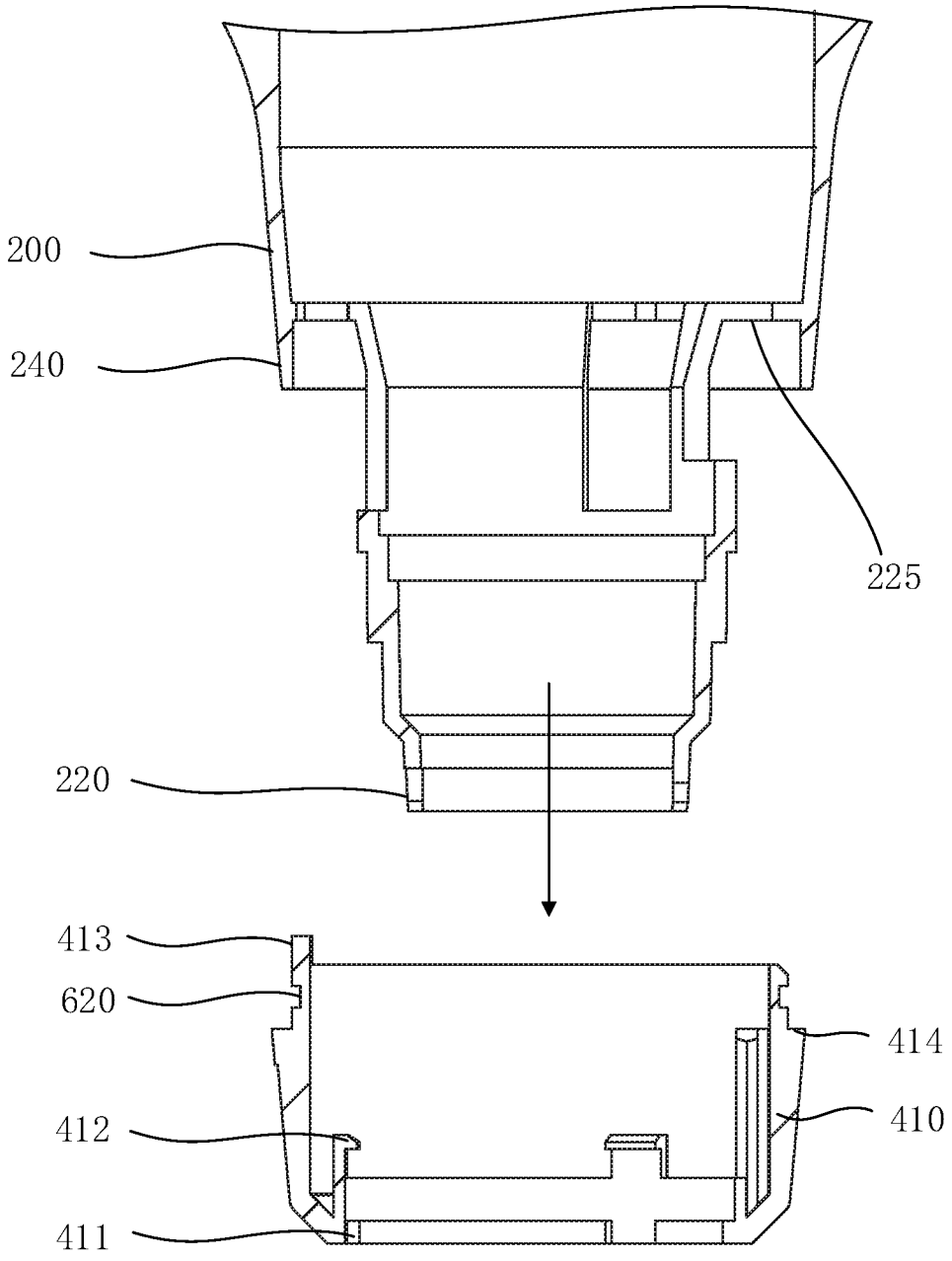
FIG. 5 illustrates how to assemble a rotating switch assembly.

In FIG. 5, the narrow end 220 of the light housing 200 is inserted into the rotating ring 410 via the top end of the rotating ring 410 and passing through the bottom of the rotating ring 410 to be fixed to the cap 100.

In some embodiments, the width of the second protruding edge 230 along the axial direction of the light housing 200 is matching to a distance between the first protruding edge 411 and the buckle 412.

As such, when the second protruding edge 230 enters between the first protruding edge 411 and the buckle 412, the second protruding edge 230 is fixed between the first protruding edge 411 and the buckle 412. such design prevents the rotating ring 410 moving to damage the pushing switch 420 and/or the light source assembly 300.

In some embodiments, there is a reserved spacing between the first protruding edge 411 and the buckle 412. The top end of the rotating ring 410 engages the light housing 200 and the bottom of the rotating ring 410 engages the cap 100 to prevent the rotating ring 410 to move randomly relative to the wide open end 210.

Figure 7:
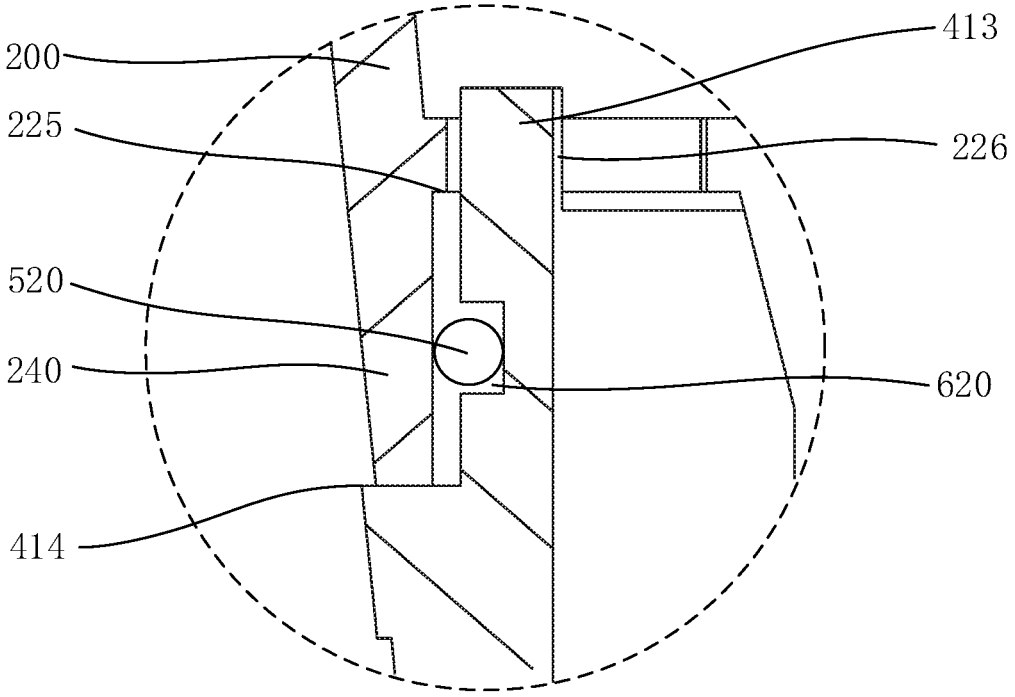
FIG. 7 is a zoom-up view of the position bin FIG. 3.

Please refer to FIG. 3, FIG. 6 and FIG. 7. In this embodiment, there is a first ladder 225 extended from an inner wall of the narrow open end 220. There is a second ladder 414 formed as a ring on an exterior peripheral of the top of the rotating ring 410. There is a stop 240 extended from the intersection area between the first ladder 225 and the exterior wall of the narrow open end 220.

The bottom of the stop 240, which refers to the side away from the first ladder 225, engages the second ladder 414. The top of the rotating ring 410 is movably engaged to the first ladder 225.

The bottom of the rotating ring 410 is movably connected to the edge of the cap 100. The rotating ring 410 is closely fixed between the first ladder 225 and the cap 100. In this embodiment, the stop 240 is formed as part of an unibody structure at the position between the first ladder 225 and the exterior wall of the narrow open end 220.

Furthermore, the rotating ring 410 has its top extended with a limiting column 413. There is a corresponding limiting cavity 226 with a larger width in the first ladder 225. The limiting column 413 is extended to the limiting cavity 226 and may form a limited rotation structure to two ends of the limiting cavity 226, so as to prevent the rotating ring 410 to move too much to damage the pushing switch 420 and/or the light source assembly 300.

Furthermore, the lighting apparatus may further include a first sealing ring 510 and a second sealing ring 520. The first sealing ring 150 is connected outside the narrow open end 220 and is kept between the first protruding edge 411 and the second protruding edge 230. The second sealing ring 520 is disposed outside the top of the top of the rotating ring 410 and kept between an inner wall and an exterior wall of the top of the rotating ring 410. Such sealing rings prevent water or dust entering the rotating part or inside of the light housing 200 to make the lighting apparatus with waterproof function.

The light source assembly 300 may include a light source plate 310 and a driving board 320. The light source board 310 includes a substrate plate (not shown) and LED modules mounted on the substrate plate (not shown).

Components of the driving board 320 and the light source board 310 are electrically connected. The pushing switch 420 is mounted on the driving board 320 and electrically connected to corresponding components like a driver integrated circuit. One end of the pushing switch 420 is extended outside the light housing 200 to engage the rotating ring 410.

In FIG. 4, there are two fixing blocks 415 inside the inner wall of the rotating ring 410. There is a limiting block 425 on the pushing switch 420 away from the driving board 320. The limiting block 425 is fixed between the two fixing blocks to form the rotating switch assembly.

In some embodiments, the lighting apparatus may further include a heat dissipation aluminum cover 700. The heat dissipation aluminum cover 700 is fixed to the wide open end 210. The heat dissipation cover 700 is used for surrounding the light source board 310 to help heat dissipation of the light source board 310. The light housing 200 may be plastic material embedded with aluminum piece to further enhance heat dissipation.

The heat dissipation cover 700 may include a bottom plate 710 and a heat dissipation wall 720 extended from the bottom plate 710 away from the bottom plate 710. Light is escaped from one end away from the bottom plate 710. Specifically, the light of the light source board 310 is emitted outside the end away from the heat dissipation cover 700.

In some embodiments, the lighting apparatus may also include a lens 800 and a lamp shell 900. The lens 800 is disposed on the bottom plate 710 and the lamp shell 800 is disposed on the wide open end.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a connector;

a housing connecting to the connector;

a light source assembly configured within the housing, wherein the light source assembly comprises a driving board and a light source board, the driving board electrically connects to the light source board, and a switch is configured on the driving board; and a ring-shaped element movably fixed on an outer surface of the housing, wherein the ring-shaped element interferes with the switch, wherein a first end of the housing has a rim forming an opening, a second end of the housing is fixed within the connector, wherein a first protrusion ring and a latch are formed on an inner side of the ring-shaped element, the first protrusion ring and the latch are configured in sequence along an axial direction of the opening away from the connector, the second end of the housing has a second protrusion ring movably fixed between the first protrusion and the latch, and a first ring-shaped slot is formed between the first and the second protrusion, wherein two fixing blocks are formed on the inner side of the ring-shaped element, the fixing blocks protrudes toward the driving board, and the switch is located between the two fixing blocks.

2. The lighting apparatus of claim 1, wherein the two fixing blocks extend into the housing.

3. The lighting apparatus of claim 1, wherein the ring-shaped element is slidable along the axial direction of the opening, the fixing blocks are configured to push the switch to different positions to selectively control the driving board to output different control signals in response to a distance between the ring-shaped element and the connector.

4. The lighting apparatus of claim 3, wherein the lighting apparatus further comprises a communication interface, when the distance is less than a predetermined distance, the driving board is configured to output the control signals to activate the communication interface.

5. The lighting apparatus of claim 3, wherein when the distance is less than a predetermined distance, the light source board is configured to emit light having a color temperature between 5000 k and 6000 k in response to the control signals output by the driving board.

6. The lighting apparatus of claim 5, wherein the communication interface is configured to be WIFI or Bluetooth.

7. The lighting apparatus of claim 1, wherein the switch protrudes toward the ring-shaped element and extends outside of the housing.

8. The lighting apparatus of claim 7, wherein the light source board comprises a substrate and a plurality of light emitting diode (LED) emitters configured on the substrate.

9. The lighting apparatus of claim 8, wherein when the ring-shaped element rotates to a first position, a portion of the LED emitters are turned off.

10. The lighting apparatus of claim 8, wherein when the ring-shaped element rotates to a first position, the driving board controls the adjacent LED emitters to turn on and turn off alternatively.

11. The lighting apparatus of claim 8, wherein reflective material is coated on the substrate.

12. The lighting apparatus of claim 1, wherein the ring-shaped element rotates relative to the connector along the axial direction of the opening, the fixing blocks are configured to push the switch to different positions to selectively control the driving board to output different control signals in response to a relative rotation of the ring-shaped element and the connector.

13. The lighting apparatus of claim 12, wherein the second end of the housing has a first step structure, one end of the ring-shaped element away from the connector extends into the first step structure.

14. The lighting apparatus of claim 13, wherein a limiting groove is formed on the first step structure, an upper end of the ring-shaped element extends to the limiting groove, such that the relative rotation between the ring-shaped element and the connector is limited.

15. The lighting apparatus of claim 13, wherein a second step structure is formed on an outer surface of the ring-shaped element, the housing comprises a surrounding cover adjacent to the second end, the surrounding cover extends toward the connector and abuts against the second step structure.

16. The lighting apparatus of claim 15, wherein a first sealing ring is sleeved on the first ring-shaped slot, and the housing and the ring-shaped element cooperatively holding the first sealing ring.

17. The lighting apparatus of claim 15, wherein a second ring-shaped slot is formed on an outer surface of the housing corresponding to the ring-shaped element, a second sealing ring is sleeved on the second ring-shaped slot, and the surrounding cover and the housing cooperatively holding the second sealing ring.

* * * * *